US005097974A

United States Patent [19]

Rozenberg

[11] Patent Number: 5,097,974

[45] Date of Patent: Mar. 24, 1992

[54] TAMPER-EVIDENT CLOSURES

[76] Inventor: Oleg Rozenberg, 2357 E. 19th St., Brooklyn, N.Y. 11229

[21] Appl. No.: 652,199

[22] Filed: Feb. 7, 1991

[51] Int. Cl.[5] ..... B65D 55/02; B65D 41/48; B65D 41/34

[52] U.S. Cl. ..... 215/225; 215/256; 215/252; 215/258; 215/224; 215/206

[58] Field of Search ..... 215/252, 203, 206, 225, 215/258, 223, 224, 225, 206, 256

[56] References Cited

U.S. PATENT DOCUMENTS

| | | | |
|---|---|---|---|
| 2,913,134 | 11/1959 | Randlett | 215/206 X |
| 3,703,974 | 11/1972 | Boxer et al. | 215/223 X |
| 3,974,929 | 8/1976 | Montgomery | 215/216 |
| 3,980,194 | 9/1976 | Costa | 215/223 |
| 4,043,475 | 8/1977 | Wheeler | 215/206 X |
| 4,071,156 | 1/1978 | Lowe | 215/224 |
| 4,087,016 | 5/1978 | Towns et al. | 215/211 |
| 4,342,400 | 8/1982 | Llera | 215/256 |
| 4,375,859 | 3/1983 | Fillmore | 215/223 |
| 4,417,666 | 11/1983 | Roberts | 215/256 |
| 4,436,212 | 3/1984 | Llera | 215/252 |
| 4,449,639 | 5/1984 | Davis | 215/224 |
| 4,511,051 | 4/1985 | Desai | 215/225 |
| 4,524,876 | 6/1985 | Kusz | 215/224 |
| 4,527,702 | 7/1985 | Heath, Jr. | 215/225 |
| 4,573,598 | 3/1986 | Perry | 215/204 |
| 4,573,599 | 3/1986 | Fillmore | 215/225 |
| 4,579,239 | 4/1986 | Hart | 215/224 |
| 4,700,860 | 10/1987 | Li | 215/256 |
| 4,771,904 | 9/1988 | Perne et al. | 215/252 |
| 4,813,561 | 3/1989 | Ochs | 215/252 |
| 4,907,708 | 3/1990 | Csaszar | 215/252 |
| 4,907,709 | 3/1990 | Abe et al. | 215/252 |
| 4,984,701 | 1/1991 | Margaria | 215/256 |

*Primary Examiner*—Stephen Marcus
*Assistant Examiner*—Vanessa Caretto
*Attorney, Agent, or Firm*—Klauber & Jackson

[57] ABSTRACT

Frangible areas of different configurations are formed between the cap and skirt portions of a unitary molded plastic closure, with an internal continuous groove formed on the inside surface of the skirt portion having a diameter slightly larger than the outer diameter of an upper cap portion, the groove having an inner diameter slightly larger than the outer diameter of the cap, the groove lockingly engaging in a tight-fitting manner with the outer peripheral wall of the annular collar on the neck of the container when the closure is assembled with the container, and the groove together with ribs formed proximate to the groove provide a locking engagement between the container neck and the lower skirt portion, facilitating forming an annular collar on the container neck with an outer diameter larger than the outer diameter of the upper cap portion so as to prevent the closure from being pried off by children during use of the contents of the container.

11 Claims, 2 Drawing Sheets

TAMPER-EVIDENT CLOSURES

This invention relates to closures and, more particularly, to tamper-evident closures.

Many bottles and other containers are provided with caps, covers or closures formed to reveal whether the container has unwarrantedly been opened. Such containers and closures are used for pharmaceutical products, patent medicines and the like, but are just as important for all products which are meant to be used for human consumption. Such closures warn the user that the contents may have been tampered with and in turn discourage the criminal practice of tampering with packaged products.

A considerable number of such containers made either of plastic or glass utilize plastic closures. However, closures of the type shown in U.S. Pat. No. 4,103,803, issued on Aug. 1, 1978 to R. T. Irvine for Tamperproof Container and Cap Assembly, merely provide a skirt portion separable from a cap portion by a frangible section and may be found inadequate because once the closure has been opened it cannot be recapped.

On the other hand, container closures like those shown in U.S. Pat. No. 4,281,774, issued on Aug. 4, 1981 to G. V. Mumford for Tamper Proof Snap Cap, have a skirt with a lower surface which may help to slowly pry up the closure, especially where it is by construction spaced from the container wall. When such a closure is pried up slowly, it is possible that the tamper-proof strip will not separate, and then the contents can be tampered with and the container reclosed. Meticulous opening and reclosing of such a container may be required, but those who might want to tamper with the container seem to be willing to devote the time and effort to do so. Other prior art container closures, like those shown in U.S. Pat. No. 3,979,003, issued on Sept. 7, 1976 to D. O. Allen for Reusable Frangible Closure, U.S. Pat. No. 4,166,552 issued on Sept. 4, 1979 to G. W. Faulstich for Plastic Cap and Container Construction and U.S. Pat. No. 4,438,857, issued on Mar. 27, 1984 to J. J. Bullock, III for Cap and Neck Structure for a Wide-Mouth Jar, require relatively complex and expensive mechanisms for molding into the closure the area of reduced strength that would facilitate the fracture of the skirt from the closure cap. These constructions, furthermore, are not usable with screw top jars which are often required for reclosable containers.

Container closures of the type shown in U.S. Pat. No. 4,305,517, issued on Dec. 15, 1981 to S. W. Dennis for Tamperproof Closure, also require quite costly and complex molds and mechanisms to form the vertical and horizontal grooves and slot arrangements needed to facilitate operation of the tab and opening of the closure. On the other hand, closures like the one shown in U.S. Pat. No. 4,307,821, issued on Dec. 29, 1981 to J. A. McIntosh for Container-Closure Assembly, is for particular types of containers and is not adaptable for tamper-evident containers in general.

Container closures of the type shown in British Patent No. 809,398, issued on Feb. 25, 1959 for Tamper-Proof Caps for Bottles and Other Receptacles, can be easily tampered with by squeezing the lower ring between the four equally spaced teeth formed on a container neck which are engaged with the teeth formed on the inner surface of the lower portion of the closure and can be easily seen from the top of a sealed container. By squeezing the lower portion of the closure between these four teeth, they can be easily disengaged and the cap unscrewed by a small amount. By carefully repeating the procedure several times, the closure can be removed without any damage to the frangible area and capped again.

Some of the available tamper-evident closures are formed by first molding the cap. The cap is then cut through along a predetermined line to form a weakened area about which the cap fractures when opened. The additional operation which is needed to form the cuts through the cap requires additional cap handling and adds to the cost of the closure.

To form the cuts through the cap material during the closure molding operation, as shown in U.S. Pat. No. 4,343,408, issued on Aug. 10, 1982 to E. J. Csaszar for Tamper-Evident Plastic Closure, however, requires the use of quite complex and expensive molds with slides which may prove unreliable.

U.S. Pat. Nos. 4,784,281 and 4,909,404, both having the same inventor herewith, disclose tamper-evident closures. However, formation and construction of these closures are disadvantageous from the manufacturing standpoint and there is the possibility that the tamper-evident closures therein can possibly be pried off by children's teeth. As to the manufacture, the closures of these patents are provided with vertical grooves in the external portion of the caps to provide the frangible areas. This becomes cumbersome during the molding operation.

SUMMARY OF THE INVENTION

It is therefore an object of the present invention to provide new and improved tamper-evident closures.

It is another object of this invention to provide new and improved tamper-evident closures for screw top containers.

It is yet another object of this invention to provide new and improved tamper-evident closures for snap top containers.

It is yet another object of this invention to provide new and improved tamper-evident closures with frangible areas that are stronger in one direction of rotation than in the opposite direction of rotation.

It is still another object of this invention to provide new and improved child-resistant tamper-evident closures.

Other objects, features and advantages of the invention in its details of construction and arrangements of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

This invention involves tamper-evident closures and contemplates forming the closure with a cap portion and a skirt portion connected together by a separation area of weakened construction, such that any operation of the closure to remove the closure from the container will effect separation of the skirt portion from the cap portion at the weakened area and make readily evident that the closure has been opened. The weakened area is either accomplished by forming openings, or cuts, through the closure wall from the inside of the closure during molding thereof, or by molding the closure so that the thickness of the wall at such area is relatively thin when compared to the adjacent wall portions. The closure skirt portions are also formed to facilitate ejection of the molded closure from the mold.

With the present invention, there is no need to provide vertical grooves in the exterior surface of the cap portion of the closure in order to form the frangible areas. Specifically, the entire closure of the present invention can be formed on one core and stripped from that core.

Further, with the present invention, the skirt portion is formed with a groove which snugly or tightly receives the outer peripheral wall of the lower annular collar on the neck of the container. This provides added security against tampering.

DESCRIPTION OF THE PREFERRED EMBODIMENTS

Figure 1:
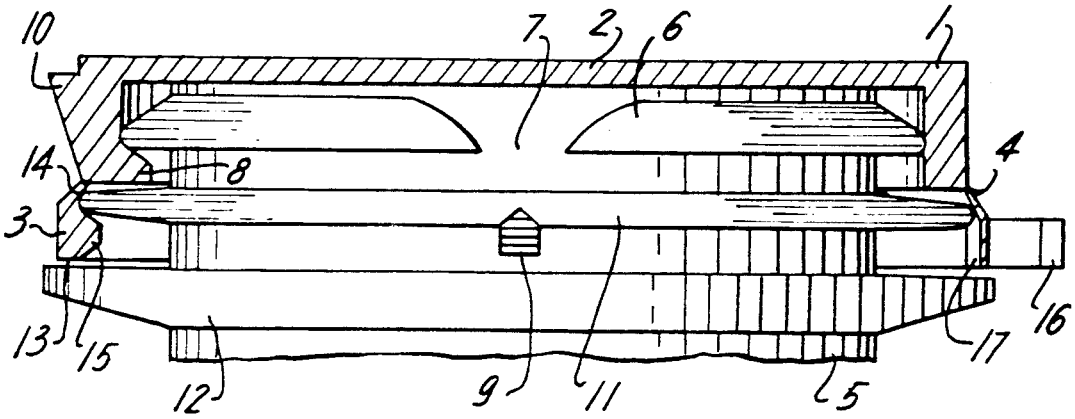
FIG. 1 is an enlarged view, in partial section, of a tamper-evident closure, incorporating the instant invention, and showing the same applied to the neck of the container.

With reference to FIG. 1, there is generally shown a closure 1 as a tamper-evident, child-resistant push on closure. Closure 1 includes an upper portion 2, which is a regular child-resistant cap and a lower skirt portion 3. Skirt 3 is connected to the upper cap by a weakened or frangible area 4, a relatively thin membrane formed during the molding of closure 1 in such a way as to provide a tamper-evident construction of closure 1. Container 5 is formed of suitable materials in such a way as to provide a child-resistant and tamper-evident construction that will cooperate with a child-resistant and tamper-evident construction of the closure 1. The neck of a container 5 is provided with a collar 6 that has a gap 7. The upper portion 2 of closure 1 is molded with a number of ribs, all of which but one are too large to pass through the gap 7 and a small rib 8 which is sized to pass through the gap 7. An arrow 9 is formed on the outside surface of the neck of the container 5 to indicate the location of the gap 7, while arrow 10 is formed on the upper portion of the closure 1 to indicate the location of the rib 8. Only when both arrows are aligned, which means that the small rib is located under the gap, can the upper portion 2 of the closure 1 be removed from the container 5. In addition to this an annular collar 11 with an outside diameter slightly larger than the outside diameter of an upper cap portion 2 is formed under the upper cap portion 2 on the container 5, to prevent the closure from being pried off by children's teeth. This construction makes the upper portion 2 of closure 1 child-resistant.

An annular collar 12 larger than annular collar 11 is added to the container neck. The collar 12 cooperates with the bottom surface 13 of the closure 1 to prevent it from being pried off.

A skirt 3 is added to the upper portion 2 to render the closure 1 tamper-evident. The skirt 3 of the closure 1 is formed with an internal groove 14 that cooperates with the outside surface of the collar 11. A locking engagement between the groove 14 and collar 11 makes it difficult to pry the closure off container 5 without breaking the frangible connection 4. In addition to providing a locking engagement between the lower skirt portion 3 and annular collar 11, the groove 14 permits forming the upper cap portion 2 with an outer diameter smaller than the outer diameter of annular collar 11. This is needed to improve the child-resistant feature of the upper cap portion and prevent it from being pried off by a child's teeth.

In addition to groove 14, a number of inwardly directed ribs 15 can be formed on the inner surface of skirt 3 to improve a locking engagement between the skirt 3 and annular collar 11. After closure 1 is applied unto container 5, the skirt 3 covers the arrow 9 so as to obscure it and hinder the alignment of the gap 7 with the small rib 8. However, should the gap 7 and the small rib accidentally align, the cooperation of the groove 14 and ribs 15 with the collar 11 will prevent prying the closure 1 off the container 5. A pull tab 16 is formed to extend out from the skirt 3, and a groove 17 is formed proximate to the tab 16 to facilitate breaking of the skirt 3.

When it is desired to obtain access to the contents of the container 5, one needs only to pull the tab 16 with a force sufficient to fracture the weakened area 4 and separate the skirt 3 from the upper portion 2. Thereafter, the alignment of the arrows 9 and 10 will permit the removal of the upper portion 2 of the closure 1 from the container 5. If the skirt 3 is removed, or if the weakened area 4 has been fractured, the user would become alert to the possibility of the tampering.

Figure 2:
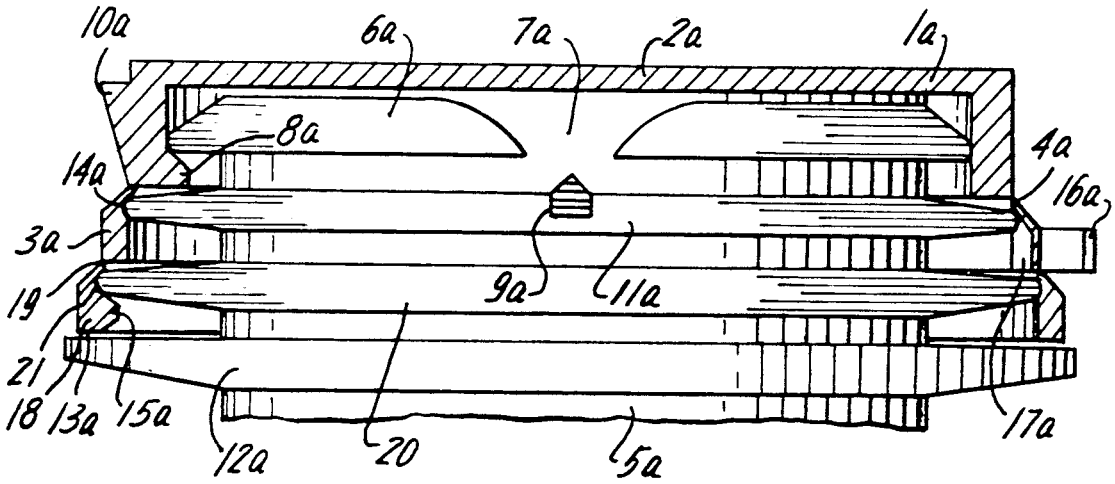
FIG. 2 is an enlarged view, in partial section, of another tamper-evident closure, incorporating the instant invention, and showing the same applied to the neck of a container.

The embodiment shown in FIG. 2 shows a closure **1*a* as a tamper-evident, child-resistant push-on type closure. The upper cap portion 2*a* of closure 1*a* is similar to the upper cap portion described in FIG. 1 of the present invention and works as a regular child-resistant push-on type closure. The lower skirt portion 3*a* is also similar to the skirt portion described in FIG. 1 and is connected to the upper cap by a weakened or frangible area 4*a* by a relatively thin membrane formed during the molding of closure 1*a*. In addition to the lower skirt portion 3*a*, an additional skirt portion 18 is formed under the lower skirt portion. Skirt 18 is connected to the lower skirt portion by a weakened area 19 formed during the molding of the closure 1*a***.

Container **5*a* is formed of suitable material in such a way as to provide both child-resistant and tamper-evident construction that would cooperate with closure 1*a*. The neck of container 5*a* is provided with a collar 6*a* that has a gap 7*a*. The upper cap portion 2*a* of closure 1*a* is molded with a number of ribs, all of which but one are too large to pass through the gap 7*a*, and a small rib 8*a* which is sized to pass through the gap 7*a*. An arrow 9*a* is formed on the outer surface of the neck of the container 5*a* to indicate the location of the gap 7*a*, while arrow 10*a* is formed on the upper cap portion of the closure 1*a* to indicate the location of the rib 8*a*. Only when both arrows are aligned, which means that the small rib is located under the gap, can the upper portion 2*a* of closure 1*a* be removed from the container 5*a*. In addition, an annular collar 11*a* with an outside diameter slightly larger than the outside diameter of upper cap portion 2*a* on the container 6*a*, is provided to prevent the upper cap from being pried off. This construction makes the upper portion 2*a* of closure 1*a*** child-resistant.

A third annular collar 20 that is slightly larger than the annular collar **11*a*** is added to the container neck.

Fourth annular collar 12a is formed on the neck of the container 6a to cooperate with the bottom surface 13a of the closure 1a to prevent it from being pried off. A skirt portion 3a is added to the upper portion 2a to render the closure 1a tamper-evident. The skirt 3a of closure 1a is formed with an internal groove 14a that cooperates with the outside surface of the annular collar 11a. A locking engagement between the groove 14a and annular collar 11a makes it difficult to pry the closure off container 5a without breaking the frangible connection 4a. In addition, to provide a locking engagement between the skirt portion 3a and annular collar 11a, the groove 14a permits forming of the upper cap portion 2a with an outer diameter smaller than the outer diameter of annular collar 11a. This improves the child-resistant feature of the upper cap portion and prevents it from being pried off.

Skirt 18 is added to the closure 1a to improve the tamper-evident feature of closure 1a and to display better when the contents of the container have been tampered with. The skirt 18 is connected to the lower skirt portion 3a by a weakened or frangible area 19, a relatively thin membrane formed during the molding of closure 1a. A number of ribs 15a can be added to the skirt 18 and annular collar 20. A groove 21 is formed on the inside surface of skirt 18 for locking engagement between skirt 18 and collar 20.

A pull tab 16a is formed to extend out from the skirt 3a, and a groove 17a is formed proximate to the tab 16 to facilitate the breaking off of the skirt 3a.

When it is desired to obtain access to the contents of the container 5a, one needs only to pull the tab 16a with a force sufficient to fracture the weakened areas 4a and 19 and separate the skirt 3a from the closure 1a. Thereafter, alignment of the arrows 9a and 10a will permit removal of the upper cap portion 2a of closure 1a off the container 6a. The skirt 18 will remain on the container. If the skirt 3a is removed from the container, the gap between the upper cap portion 2a and the skirt 18 will alert the user of possible tampering.

Figure 3:
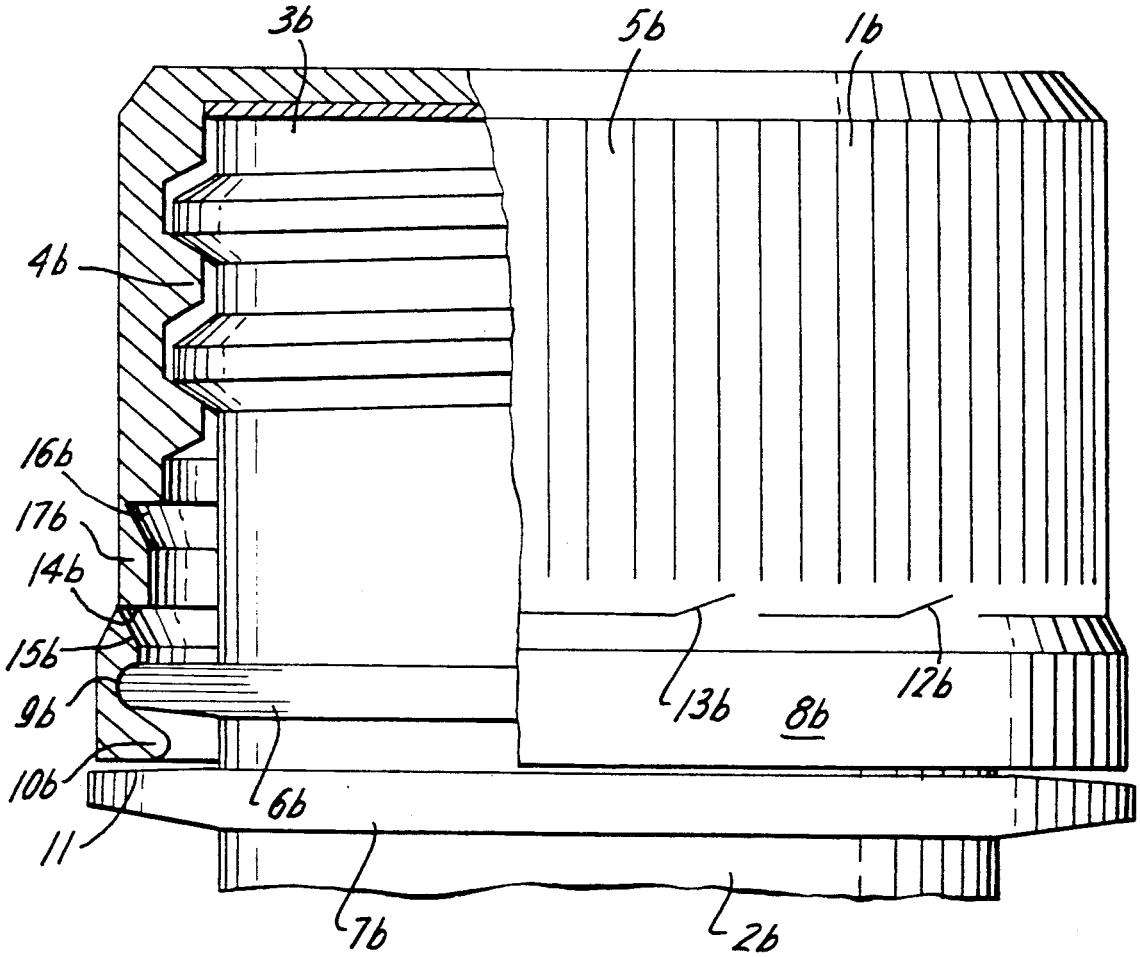
FIG. 3 is an enlarged view, in partial section, of still another tamper-evident closure, incorporating the instant invention, and showing the same applied to the neck of a container.

The embodiment shown in FIG. 3 shows a closure 1B for a container or bottle 2B having a threaded neck 3B. Container 2B is of conventional configuration and construction and formed from suitable material. The threads on the threaded neck 3B are of conventional configuration and formed for mating engagement with similarly formed internal threads 4B formed within an upper cap portion 5B of closure 1B. Closure 1B is formed form a suitable plastic by injection molding.

An upper collar 6B is formed around the neck 3B of container 2B as is a lower annular collar 7B. Closure 1B includes an upper threaded portion 5B and a lower or skirt portion 8B which is formed with an internal groove 9B. Groove 9B is formed to provide an interlocking engagement between the lower skirt portion 8B and the outer diameter of annular collar 6B.

In addition to groove 9B, a number of ribs 10B can be formed on the inner surface of skirt 8B in close proximity to groove 9B to improve the locking engagement between the skirt 8B and annular collar 6B. In addition, the skirt portion 8B can be sized such that the lower surface 11B is disposed closely adjacent to an upper surface of lower annular collar 7B so that closure 1B cannot be readily pried off container 2B.

Attempted rotation of closure 1B to unscrew it off of container 2B results in cooperation of groove 9B and undercuts 10B with annular collar 6B such that the continued application of force will fracture skirt 8B off of upper portion 5B around a weakened or frangible area 12B of closure 1B. Frangible area 12B is formed during the molding of closure 1B by cut-outs 13B in the area thereof between the upper portion 5B of closure 1B and skirt portion 8B thereof. Cut-outs 13B are formed from the inside of closure 1B during molding thereof. The cross-section of cut-outs 13B has a shape of an axial cross-section of a cone. Each cut-out 13B is defined by a top surface 14B and a bottom surface 15B. As shown in FIG. 3, the bottom surface 15B is disposed at an angle to the outside surface of upper cap portion 5B.

An annular undercut 16B is molded in upper part 5B above the cut-outs 13B to facilitate ejection of closure 1B from its mold without breaking the frangible connection 12B, leaving a strip of material 17B between the undercut 16B and cut-outs 13B. The cross-section of the undercut 16B is similar to the cross-section of the cut-outs 13B but the undercut 16B does not protrude through the wall of the upper portion 5B.

Skirt portion 8B is formed such that it diverges outwardly from the frangible area 12B to the bottom portion of closure 1B. The bottom surface 11B of skirt 8B is used to facilitate ejection of the closure 1B from its mold.

Thus, closure 1B is applied to the neck 3B of container 2B in a conventional manner. Once so applied, any attempt to remove closure 1B from container 2B must result in fracturing of closure 1B at weakened area 12B. Such fracturing will be readily apparent to the user and thus closure 1B is tamper-evident. When it is desired to remove closure 1B from container 2B to gain access to the contents therebetween, one needs only to apply appropriate force in the appropriate direction to turn closure 1B. Interlocking engagement between the groove 9B and ribs 10B with the annular collar 6B will result in fracturing of weakened area 12B and separation of the upper portion 5B of closure 1B from skirt portion 8B. The upper portion of closure 1B may thereafter be screwed onto and off of neck 3B of container 2B to open and close container 2B.

Various possible embodiments, forms and modifications of the invention, coming within the proper scope and spirit of the appended claims, will, of course, readily suggest themselves to those skilled in the art. Thus, while there have been described what are at present considered to be the preferred embodiments of the invention, it will be obvious to those skilled in the art that various changes and modifications may be made therein, without departing from the invention, and it is therefore aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. A plastic unitary molded tamper-evident, child-resistant, snap-on closure for operative association with a container which includes a neck portion having a first external annular collar with a gap, a second, lower external annular collar including an outer peripheral wall and a third lowest external annular collar, said closure comprising:

a) an upper cap portion having internal spaced ribs disposed for cooperation with the first external annular collar, only one said rib being of a size to pass through the gap of said first external annular collar, and said upper cap portion includes indication means indicating the location of said rib sized to pass through said gap, said upper cap portion having a lower end with an outer diameter smaller than an outer diameter of the second annular collar formed on the container neck and a bottom edge located in close proximity to the second annular collar when the upper cap portion is assembled with the container;

b) a lower skirt portion connected to the upper cap portion and having an inside diameter that is close to the outer diameter of the upper cap portion, said lower skirt portion having a bottom edge in close proximity to the third lowest annular collar of the container when the closure is in assembled position on the container so that the closure cannot be pried off;

c) a weakened area circumferentially formed about the closure at a connection between the lower skirt portion and the upper cap portion;

d) a continuous groove formed on an inner surface of the lower skirt portion, said groove having an inner diameter slightly larger than the outer diameter of the upper cap portion, said groove lockingly engaging in a tight-fitting manner with the outer peripheral wall of said second annular collar when the closure is assembled with the container;

e) a number of inwardly directed ribs formed on the inner surface of the lower skirt portion in close proximity to said groove, said ribs lockingly engaging said second annular collar at an engagement portion on said second annular collar which is inwardly spaced from said outer peripheral wall when the closure is assembled with the container;

f) a pull tab formed on an outer surface of the lower skirt portion; and g) a weakened area formed proximate to said pull tab and perpendicular to said weakened area formed about the closure.

2. The closure of claim 1, further including a lowest skirt portion connected to said lower skirt portion and formed with an inside diameter that is close to the outer diameter of said lower skirt portion.

3. The closure of claim 2, further including a second weakened area circumferentially formed about the closure at a connection between the lower skirt portion and said lowest skirt portion.

4. The closure of claim 2, wherein said lower skirt portion is formed with an outer diameter smaller than an outer diameter of said third annular collar formed on the container neck.

5. The closure of claim 2, wherein said third annular collar has an outer peripheral wall, and further including a groove formed on an inner surface of said lowest skirt portion, said groove lockingly engaged with an outer peripheral wall of said third annular collar when the closure is assembled with the container.

6. The closure of claim 5, wherein said groove on said lowest skirt portion lockingly engages in a tight-fitting manner with the outer peripheral wall of the third annular collar when the closure is assembled with the container.

7. The closure of claim 2, further including a number of inwardly directed ribs formed on the inner surface of said lowest skirt portion in close proximity to said groove thereof.

8. The closure of claim 7, wherein said ribs lockingly engage said third annular collar at an engagement portion on said third annular collar which is inwardly spaced from an outer peripheral wall thereof when the closure is assembled with the container.

9. The closure of claim 1, wherein said outer peripheral wall of said second annular collar has a rounded configuration and said continuous groove also has a rounded configuration to snugly receive said outer peripheral wall.

10. A plastic unitary molded tamper-evident closure formed to cooperate with a container having a threaded neck portion and interlocking elements disposed below the threaded neck portion, the interlocking elements including a first annular collar and a second, lower annular collar, the closure comprising:

a) a cap with internal threading formed to cooperate with the threaded neck portion of the container;

b) a skirt extending from said cap and formed to have interlocking elements constructed for engagement with the container interlocking elements, the skirt having a bottom edge in close proximity to the lower annular collar of the container when the closure is in assembled position on the container so that the closure cannot be pried off;

c) frangible means for interconnecting said skirt to said cap such that at least one of relative rotational and axial movements between said skirt and said cap will effect in fracturing of said frangible means and separation of said skirt from cap;

d) an annular rib formed in an inside of said cap below the internal threading and above the frangible means, said rib having a generally conical cross-section and adapted to form a flexible, stretchable annular strip of material located at a bottom portion of said cap proximate to said frangible means;

e) the frangible means formed during molding of said closure by a number of cut-outs through an inner surface of said skirt, proximate to the flexible annular strip of material located at the bottom portion of said cap, and having a generally conical cross-section similar to the cross-section of the annular undercut;

f) ejection facilitating surface means formed on the skirt outside an outer diameter of the cut-outs for providing removal of the closure from a die member incorporated to form the cut-outs;

g) a continuous groove formed on the inner surface of the skirt and having a depth and location to cooperate in locking engagement with said first annular collar formed as one said interlocking element on the container neck, with said groove lockingly engaging in a tight-fitting manner with an outer peripheral wall of said first annular collar when the closure is assembled with the container; and h) a number of inwardly directed ribs formed on the inner surface of the skirt in close proximity to said groove, said ribs lockingly engaging said first annular collar at an engagement portion thereof which is inwardly spaced from said outer peripheral wall when the closure is assembled with the container.

11. The closure of claim 10, wherein said outer peripheral wall of said first annular collar has a rounded configuration and said continuous groove also has a rounded configuration to snugly receive said outer peripheral wall.

* * * * *